US005184595A

United States Patent [19]

Maeda et al.

[11] Patent Number: 5,184,595

[45] Date of Patent: Feb. 9, 1993

[54] DISORDER DIAGNOSIS DEVICE FOR FUEL INJECTION APPARATUS

[75] Inventors: Mie Maeda; Hirofumi Ohuchi, both of Hyogo, Japan

[73] Assignee: Mitsubishi Denki Kabushiki Kaisha, Tokyo, Japan

[21] Appl. No.: 831,454

[22] Filed: Feb. 5, 1992

[30] Foreign Application Priority Data

Feb. 26, 1991 [JP] Japan ..... 3-30607

[51] Int. Cl.[5] ..... F02D 41/14

[52] U.S. Cl. ..... 123/690; 123/479

[58] Field of Search ..... 123/479, 676, 688, 690, 123/693, 694

[56] References Cited

U.S. PATENT DOCUMENTS 4,638,658 10/1987 Otobe ..... 123/690 X
4,887,576 12/1989 Inamoto et al. ..... 123/690 X
5,070,847 12/1991 Akiyama et al. ..... 123/690 X

FOREIGN PATENT DOCUMENTS 0219848 9/1988 Japan .
176140 7/1990 Japan ..... 123/690

*Primary Examiner*—Willis R. Wolfe
*Attorney, Agent, or Firm*—Sughrue, Mion, Zinn, Macpeak and Seas

[57] ABSTRACT

A disorder diagnosis device for a combustion engine having a fuel injector for each cylinder and a fuel system for supplying fuel to the injector comprises an air-fuel ratio sensor provided at an exhaust tube of the combustion engine for providing an air-fuel ratio signal indicative of an air-fuel ratio, and a control unit responsive to the air-fuel ratio sensor for calculating a first value by comparing the air-fuel ratio signal with a preset value and for calculating a second value by comparing a signal corresponding to the air-fuel ratio signal with a predetermined value so as to decide if the fuel system is in disorder on the basis of a combination of the first and second values.

5 Claims, 6 Drawing Sheets

DISORDER DIAGNOSIS DEVICE FOR FUEL INJECTION APPARATUS

BACKGROUND OF THE INVENTION

1. Field of the Invention

The present invention relates to a disorder diagnosis device for a fuel injection apparatus of a combustion engine.

2. Prior Art

Japanese Patent Public Disclosure No. 219848/85 discloses a method of deciding a fuel injection apparatus to be in disorder when an air-fuel ratio correction value becomes equal to or larger than a predetermined value in the case where fuel injection is controlled by correcting a basic injection amount by the air-fuel ratio correction value calculated from an air-fuel ratio feedback correction coefficient ($C_{FS}$) and a learning corrected coefficient.

Such a conventional disorder diagnosis method for a fuel injection apparatus has a problem of difficulty in properly deciding the fuel injection apparatus to be faulty in accordance with the state of a fuel system, because only a comparison between an air-fuel ratio correction value and a predetermined value is used for such a disorder decision.

SUMMARY OF THE INVENTION

The present invention has been proposed to solve such a problem of the prior art, and it is an object of the present invention to provide a disorder diagnosis device for a fuel injection apparatus which is capable of a proper decision on whether or not the fuel injection apparatus is in disorder in accordance with a condition of a fuel system so as to achieve appropriate air-fuel ratio feedback control.

To achieve the above object of the invention, a disorder diagnosis device for a fuel injecting apparatus comprises a control unit which operates to calculate an air-fuel ratio correction value from the output of an air-fuel ratio sensor. Such an air-fuel ratio correction value is compared with a preset value to obtain a first comparison result. A frequency of inversion or a period of output from the air-fuel ratio sensor is compared with a predetermined value to obtain a second comparison result. The obtained first and second comparison results are used in combination to decide if the fuel injection apparatus is faulty.

According to the present invention, disorder diagnosis is performed by a combination of an air-fuel ratio correction value and a frequency of inversion or a period of output from an exhaust gas sensor. This enables an appropriate disorder decision in accordance with a condition of a fuel system and an appropriate air-fuel ratio feedback control. When a fuel injection apparatus malfunctions, it is possible to detect conditions of a fuel system in detail on the basis of information of an air-fuel ratio correction value and a frequency of inversion or a period of output from the exhaust gas sensor.

The above and other objects and advantages of the present invention will become clearer from the following description taken in conjunction with the accompanying drawings.

DESCRIPTION OF A PREFERRED EMBODIMENT

Figure 1A:
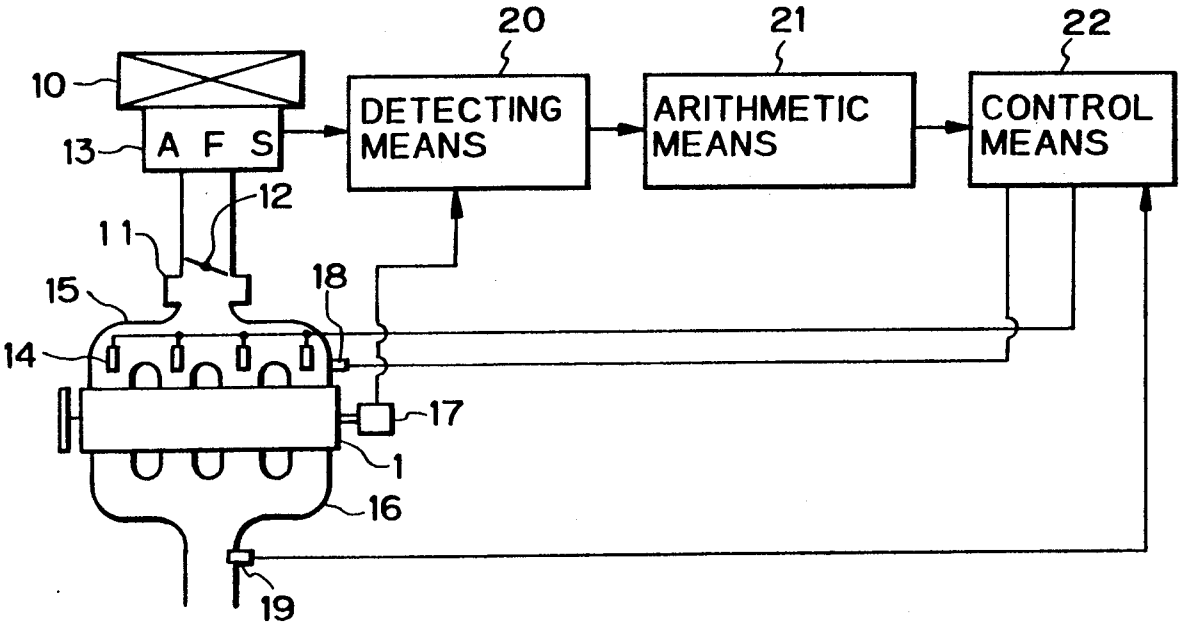
FIG. 1A is a block diagram showing the structure of an embodiment of a disorder diagnosis device according to the present invention.

An embodiment of the present invention will hereafter be explained with reference to FIGS. 1A–8. FIG. 1A shows an embodiment of a disorder diagnosis device of the present invention. In this figure, an engine 1 includes an air cleaner 10 disposed upstream of an air flow sensor (AFS) 13 which produces pulses in accordance with an amount of air flow sucked into engine 1. A crank angle sensor 17 mounted to engine 1 produces pulses the number of which corresponds to the number of rotation of engine 1. An AN detecting means 20 receives the pulses output from AFS 13 and crank angle sensor 17 and counts the number of pulses input from AFS 13 during a period of time when engine 1 rotates a predetermined angle, using the outputs of AFS 13 and crank angle sensor 17.

The output of AN detecting means 20 is supplied to an AN arithmetic means 21 which in turn calculates a true intake air amount from the output of AN detecting means 20. The calculated result is fed to a control means 22.

Engine 1 further comprises a surge tank 11, a throttle valve 12, fuel injectors 14, an intake tube 15, an exhaust tube 16, a water temperature sensor 18 and an exhaust gas sensor ($O_2$ sensor) 19 mounted to intake tube 16 and serving as an air-fuel ratio sensor. Exhaust gas sensor 19 detects an oxygen density of an exhausted gas to produce an air-fuel ratio and has an output characteristic shown in FIG. 1B. The outputs of exhaust gas sensor 19 and water temperature sensor 18 are input to control means 22.

Control means 22 receives the outputs of AN arithmetic means 21, water temperature sensor 18 and exhaust gas sensor 19 to control a period of time fuel injectors 14 are driven, thereby adjusting the amount of fuel to be supplied to engine 1.

Figure 2:
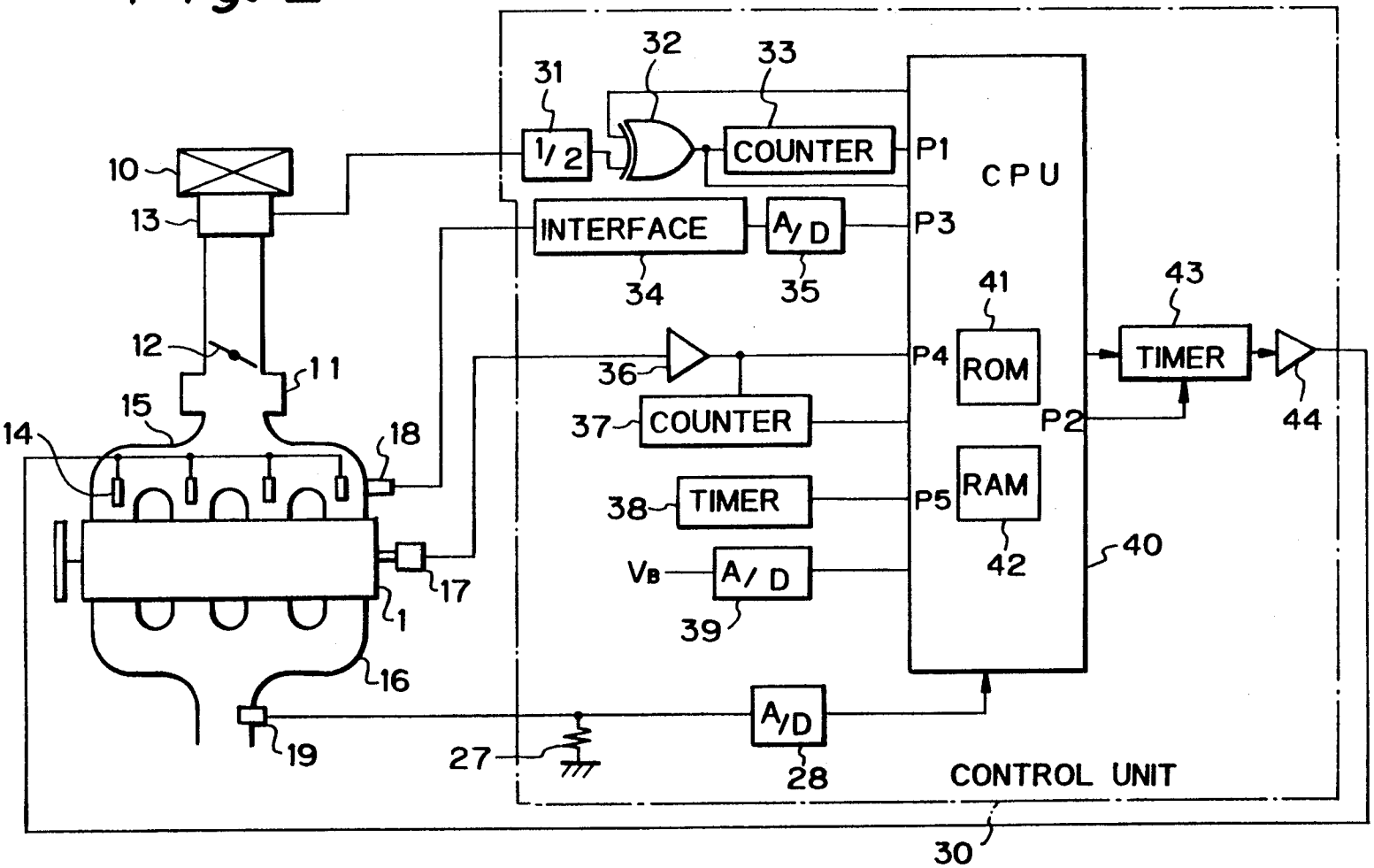
FIG. 2 shows a detailed structure of a control unit of the disorder diagnosis device shown in FIG. 1A.

FIG. 2 shows a detailed block diagram of a control unit 30 surrounded by a dotted line and indicating the internal structures of AN detecting means 20, AN arithmetic means 21 and control means 22 of the disorder diagnosis device shown in FIG. 1A. In FIG. 2, elements similar to those in FIG. 1A are designated by the same reference numerals and an explanation thereof is omitted here.

Control unit 30 receives signals output from AFS 13, water temperature sensor 18, exhaust gas sensor 19 and crank angle sensor 17 to control four injectors 14 provided for the respective cylinders of combustion engine 1 (in the case of four-cylinder engine). Such a control unit may be implemented by a microcomputer (hereafter referred to as a CPU) 40 having a ROM 41 and a RAM 42.

The output of AFS 13 is supplied to a ½ frequency divider 31, which in turn supplies an output to one input port of an exclusive OR gate 32. The other input port of exclusive OR gate 32 is connected to an output port P1 of CPU 40. An output port of exclusive OR gate 32 is connected to an input port of CPU 40.

An interface 34 is connected between water temperature sensor 18 and an A/D converter 35. The output of crank angle sensor 17 is supplied to a waveform shaping circuit 36, the output of which is fed directly to an interrupt input port P4 of CPU 40 and through a counter 37 to CPU 40.

A first timer 38 is connected to another interrupt input port P5 of CPU 40. An A/D converter 39 converts a battery voltage $V_B$ to a digital value to be fed to CPU 40. A second timer 43 is disposed between an output port P2 of CPU 40 and an input port of a driver 44, the output of which is supplied to the respective injectors 14.

The output of exhaust gas sensor 19 is input to an A/D converter 28 and the A/D converted signal is fed to CPU 40. A wire interconnecting A/D converter 28 and exhaust gas sensor 19 is grounded through a resistor 27 in order to reduce an output voltage of exhaust gas sensor 19 because the output of exhaust gas sensor 19 is high in voltage when engine 1 is at a low temperature.

Next, operation of the disorder diagnosis device will be explained. The output of AFS 13 is divided by two by frequency divider 31 and input through exclusive OR gate 32 controlled by CPU 40 to counter 33. Counter 33 measures a period of rise in edge of the output of exclusive OR gate 32. CPU 40 receives rising edges of the output exclusive OR gate 32. CPU 40 receives rising edges of the output of exclusive OR gate 32 at interrupt input port P3 and performs interrupt processing at each or every other rise in pulse output from AFS 13 so as to measure a period of pulse output from counter 33. The output of water temperature sensor 18 is converted to a voltage signal by interface 34 and A/D converted by A/D converter 35 to a digital value at an interval of a predetermined time so as to be received by CPU 40.

The output of crank angle sensor 17 is input through waveform shaping circuit 36 to interrupt input port P4 of CPU 40 and counter 37. At each rise in the output of crank angle sensor 17, CPU 40 performs interrupt processing and detects a period of rise in pulse output from crank angle sensor 17. Timer 38 supplies an interrupt signal to interrupt input port P5 of CPU 40 at an interval of a predetermined time. A/D converter 39 converts battery voltage $V_B$ to a digital voltage value, and A/D converter 28 converts the output of exhaust gas sensor 19 to a digital value and feeds the converted digital value to CPU 40. Then CPU 40 receives a digitized battery voltage value from A/D converter 39 and an A/D converted value from exhaust gas sensor 19. Timer 43 is preset by CPU 40 and triggered by an output from output port P2 of CPU 40 to supply a pulse having a predetermined width to driver 44 so as to drive injectors 14.

Before explaining operation of CPU 40, a reason why disorder of a fuel injection apparatus can be detected by a combination of an air-fuel ratio feedback correction value $C_{FS}$ and an air-fuel sensor output frequency F will be explained here from a viewpoint of a problem found when disorder is detected by merely air-fuel ratio feedback correction value $C_{FS}$, a problem found when disorder is detected merely by output frequency F and a relationship between $C_{FS}$ and F relative to a scattering of amount of injected fuel.

Figure 3:
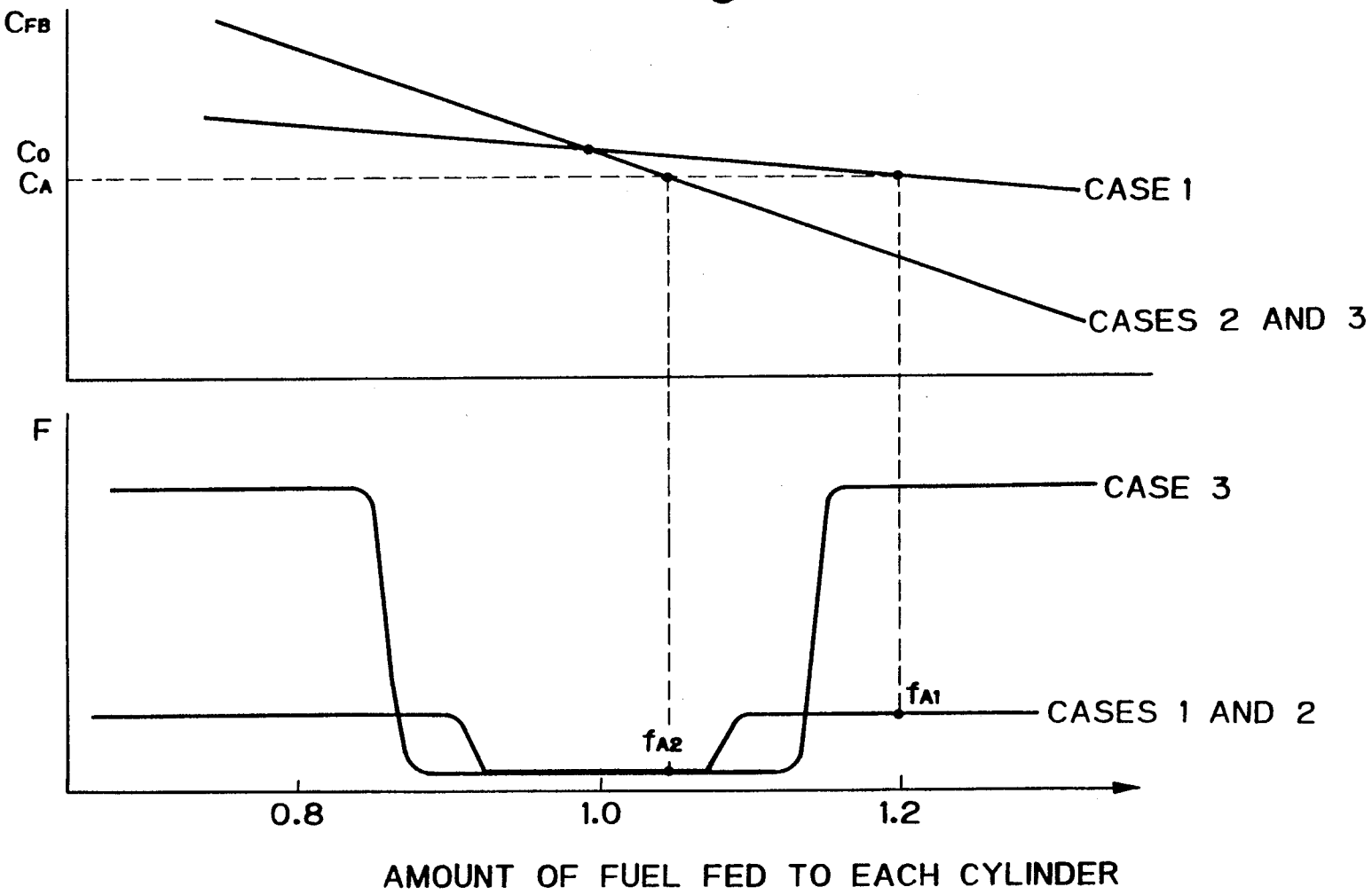
FIG. 3 shows characteristic curves indicative of relations among an air-fuel ratio feedback correction value, an exhaust gas sensor output frequency and an amount of fuel fed to each cylinder.

FIG. 3 shows a relationship between air-fuel ratio feedback correction value $C_{FS}$ and $O_2$ sensor output frequency F relative to a scattering of amount of injected fuel, using the following three cases:

Case 1: An amount of fuel injected to a first cylinder changes within ±30% from $C_{FS}=CO$;

Case 2: Amounts of fuel injected to first and second cylinders change with ±30% from $C_{FS}=CO$; and Case 3: Amounts of fuel injected to second and third cylinders change with ±30% from $C_{FS}=CO$.

As shown in FIG. 3, comparing frequency values taken at the same $C_{FS}$ value in cases 1 and 2 (for example, $C_{FS}=C_A$), case 1 shows deterioration in exhaust gas (at point $f_{A1}$) and case 2 does not show any influence to exhaust gas (at point $f_{A2}$). Consequently, in the case of disorder decision made by comparing $C_{FS}$s of cases 1 and 2 with the same predetermined value, there is a possibility of any delay in disorder detection or of any difficulty in performing a normal air-fuel ratio feedback.

Comparing cases 2 and 3, it can be seen that frequencies and influences to exhaust gas are different when air-fuel ratio feedback correction value $C_{FS}$ is the same and an amount of injected gas deviates more than a predetermined amount from a central value at a time of normal air-fuel ratio feedback.

In the case of normal air-fuel ratio feedback, CO=1.0. When a fuel pressure is reduced due to a failure of, for example, a fuel pressure regulator, CO itself deviates, but it makes little influence to exhaust gas. It may be, therefore, impossible to detect disorder of the fuel injection apparatus merely from output frequency F.

Figure 4:
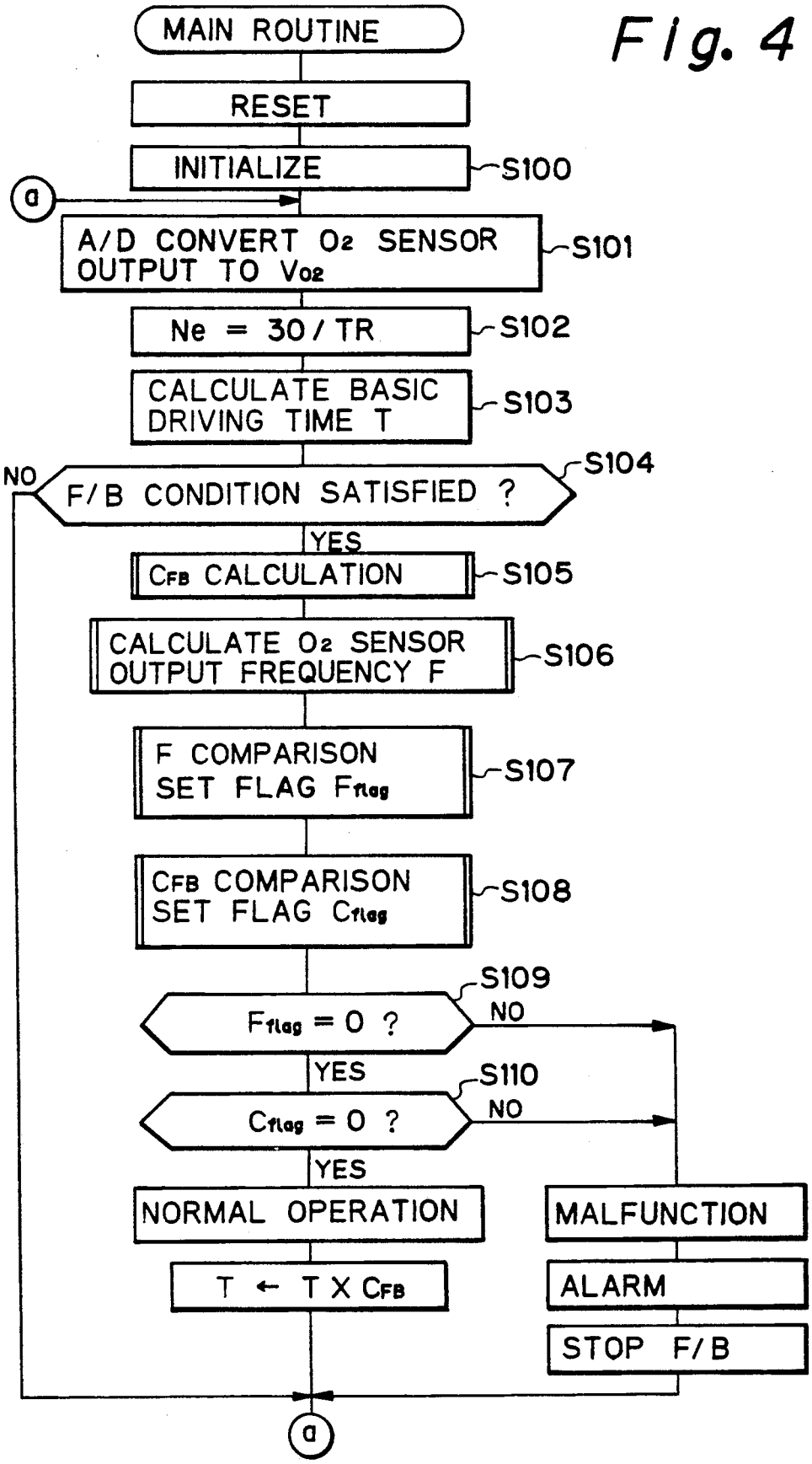
FIG. 4 is a flow chart of a disorder diagnosis program performed in a central processing unit contained in the control unit shown in FIG. 3.

Turning to FIG. 4 indicating a main program of CPU 40, operation of CPU 40 will be explained using a flow chart shown in FIG. 4. When a reset signal is input to CPU 40, such components as RAM 42 and input/output ports are initialized at a step S100, and, then, the output of exhaust gas sensor 19 is converted by A/D converter 28 and the A/D converted value is stored as $V_{02}$ in RAM 42 at a step S101.

At a step S102, the number of engine rotation Ne is calculated from 30/TR where TR is a period of pulse output from crank angle sensor 17. At a step S103, a basic driving time T is calculated from the output of AFS 13 and other signals.

At a step S104, a decision is made as to whether an air-fuel ratio feedback condition has been satisfied. If the decision indicates that such a feedback condition has not been satified, any feedback control is not performed and steps S101–S104 are repeated. If the decision shows that the air-fuel ratio feedback condition has been satisfied, an air-fuel ratio feedback correction value $C_{FS}$ is calculated at a step S105.

Figure 1B:
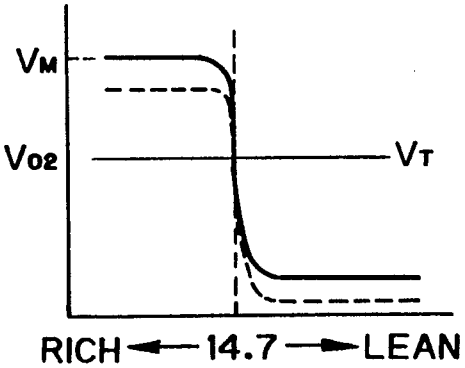
FIG. 1B shows an output characteristic of an exhaust gas sensor shown in FIG. 1A.
Figure 5:
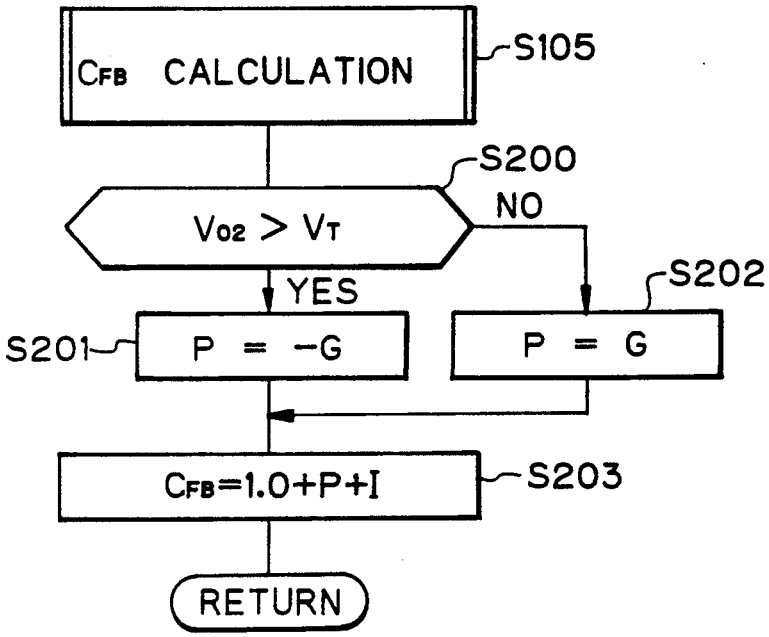
FIG. 5 is a flow chart of a subroutine performed in a step S105 of the flow chart shown in FIG. 3.

FIG. 5 shows substeps performed at step S105. At a step S200, $V_{02}$ is compared with a reference value $V_T$. Since the output of exhaust gas sensor 19 has such a characteristic as shown in FIG. 1B, $V_{02}$ becomes equal to $V_T$ when a theoretical air-fuel ratio is 14.7. If it is decided that $V_{02} > V_T$ as a result of comparison made at step S200, P is set to be equal to $-G$ at a step S201. If the comparison made at step S200 results in $V_{02} < V_T$, P is set to be equal to G at a step S202. At a step S203, an air-fuel ratio feedback correction value $C_{FS}$ is calculated such that $C_{FS} = 1.0 + P + I$.

Figure 6:
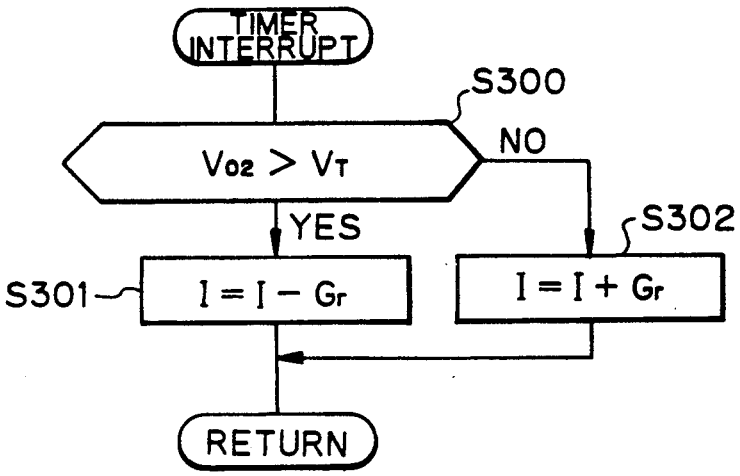
FIG. 6 is a flow chart of a subroutine performed in a step S203 of the flow chart shown in FIG. 5.
Figure 7:
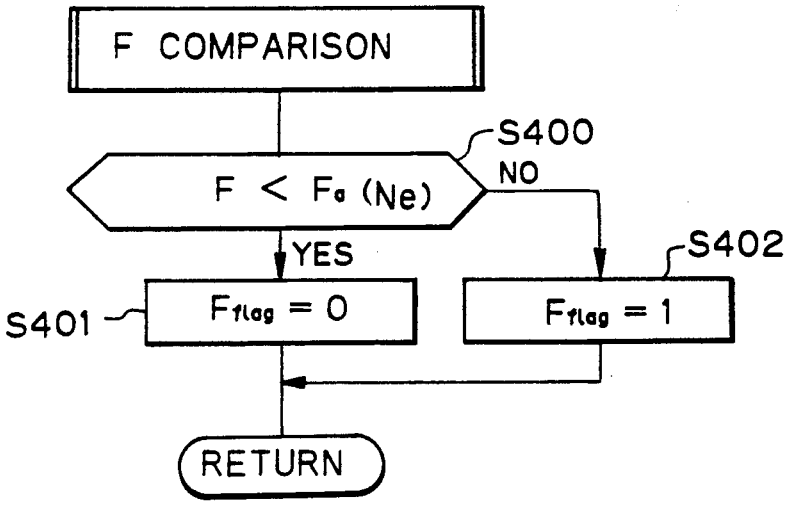
FIG. 7 is a flow chart of a subroutine performed in a step S107 of the flow chart shown in FIG. 3.
Figure 8:
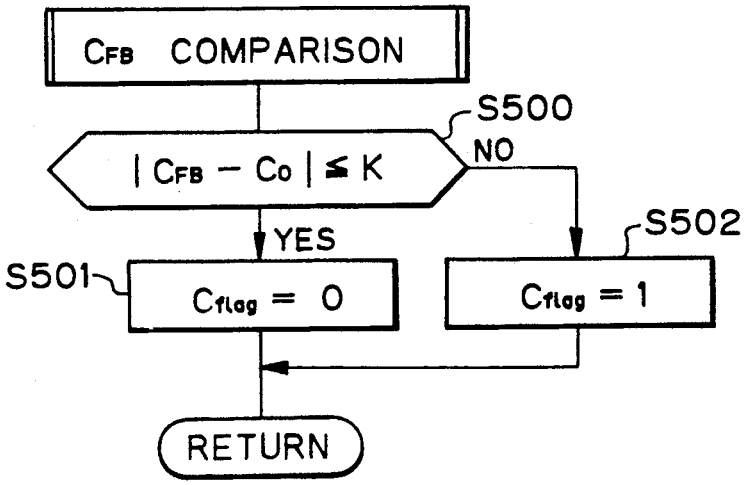
FIG. 8 is a flow chart of a subroutine performed in a step S108 of the flow chart shown in FIG. 3.

An accumulated value I can be obtained from a flow chart shown in FIG. 6. If $V_{02} > V_T$ at a step S300, the program proceeds to a step S301 at which a new accumulated value is calculated from a subtraction of GI from the previous value of I. If step S300 indicates that $V_{02} < V_T$, I is renewed by adding GI to the previous value of I at a step S302.

Returning to FIG. 4, an output frequency F of exhaust gas sensor 19 is calculated at a step S106 by measuring a period of inversion of output from exhaust gas sensor 19. At a step S107, frequency F obtained at step S106 is compared with a predetermined value Fa. This step is shown in detail in FIG. 7. At a step S400, frequency F is compared with predetermined value Fa which is equal to, for example, $(Ne/30) \times \frac{1}{4}$. If frequency F is sufficiently small, meaning that there is no substantial influence to exhaust gas, a frequency comparison flag $F_{flag}$ is set to 0 at a step S401. If step S400 indicates that frequency F is equal to or larger than predetermined value Fa, meaning that the exhaust gas is deteriorated, frequency comparison flag $F_{flag}$ is set to 1 at a step S402.

Next, a step S108 in a flow chart shown in FIG. 4 performs a $C_{FS}$ comparison. This step will be explained in detail with reference to FIG. 8. At a step S500, air-fuel ratio feedback correction value $C_{FS}$ is compared with reference value CO which is equal to, for example, 1.0. If the difference between $C_{FS}$ and CO is equal to or smaller than a preset value K, meaning that a normal air-fuel ratio feedback condition has been achieved, the program proceeds to a step S501 where a correction constant comparison flag $C_{flag}$ is set to 1. If the difference between $C_{FS}$ and CO is larger than K, correction constant comparison flag $C_{flag}$ is set to 0 at a step S502.

Turning back to FIG. 4, at steps S109 and S110, decisions are made as to whether the fuel system is normal or not. If $F_{flag}$ is set to 0 at step S109 meaning that there is no influence to the exhaust gas and $C_{flag}$ is set to 1 at step S110 indicating a normal air-fuel ratio feedback condition, it is decided that the fuel system is normal, and an air-fuel ratio feedback control is performed using $C_{FS}$ calculated at step S105. When $F_{flag}$ is 1 at step S109 or $C_{flag}$ is 1 at step S110, it is decided that there is any disorder in the fuel system and an air-fuel ratio feedback control is stopped. At this time, it is possible to have a clear grasp of a condition of the fuel system on the basis of information of air-fuel ratio feedback correction value $C_{FS}$ and $O_2$ sensor output frequency F.

The present invention has been described in detail with reference to a preferred embodiment thereof, but it should be noted that modifications and variations may be possible without departing from the scope and spirits of the invention. For example, in the illustrated embodiment, disorder of a fuel system is decided in accordance with values taken by $C_{FS}$ and F, but similar advantages may be brought about by changing a decision value of $C_{FS}$ in response to a value of F.

What is claimed is:

1. A disorder diagnosis device for a combustion engine having a fuel injector for each cylinder and a fuel system for supplying fuel to the injector, comprising:

a first means provided at an exhaust tube of said combustion engine for providing an air-fuel ratio signal indicative of an air-fuel ratio;

a second means responsive to said first means for calculating a first value by comparing said air-fuel ratio signal with a present value and for calculating a second value by comparing a signal corresponding to said air-fuel ratio signal with a predetermined value; and a third means responsive to said second means for deciding if said fuel system is in disorder on the basis of a combination of said first and second values.

2. Device according to claim 1 wherein said first means is an air-fuel ratio sensor.

3. Device according to claim 1 wherein said second means comprises a means for calculating an air-fuel ratio feedback correction value, a means for deciding if the calculated air-fuel ratio feedback correction value is normal, and a means for calculating an air-fuel ratio sensor output frequency or time period, and said third means comprises a means for deciding if the output frequency or time period is normal and a means for deciding if said fuel system is normal.

4. A disorder diagnosis device for a combustion engine having a fuel injector for each cylinder and a fuel system for supplying fuel to the injector, comprising:

an air-fuel ratio sensor provided at an exhaust tube of said combustion engine for providing an air-fuel ratio signal indicative of an air-fuel ratio; and a control unit responsive to said air-fuel ratio sensor for calculating a first value by comparing said air-fuel ratio signal with a present value and for calculating a second value by comparing a signal corresponding to said air-fuel ratio signal with a predetermined value so as to decide if said fuel system is in disorder on the basis of a combination of said first and second values.

5. Device according to claim 4 wherein said control unit comprises a means for calculating an air-fuel ratio feedback correction value, a means for deciding if the calculated air-fuel ratio feedback correction value is normal, a means for calculating an air-fuel ratio sensor output frequency or time period, a means for deciding if the output frequency or time period is normal, and a means for deciding if said fuel system is normal.

* * * * *